US007694484B2

(12) United States Patent
Lucas et al.

(10) Patent No.: US 7,694,484 B2
(45) Date of Patent: Apr. 13, 2010

(54) PANEL EDGE JOINT

(76) Inventors: James Walter Lucas, 44 Coolmunda Street, Marsden QLD 4132 (AU); Trevor Rodney Lee, 49 Second Ave., Marsden QLD 4132 (AU)

( * ) Notice: Subject to any disclaimer, the term of this patent is extended or adjusted under 35 U.S.C. 154(b) by 690 days.

(21) Appl. No.: 10/577,768

(22) PCT Filed: Oct. 29, 2004

(86) PCT No.: PCT/AU2004/001506

§ 371 (c)(1),
(2), (4) Date: Nov. 9, 2006

(87) PCT Pub. No.: WO2005/043055

PCT Pub. Date: May 12, 2005

(65) Prior Publication Data

US 2007/0095094 A1 May 3, 2007

(30) Foreign Application Priority Data

Oct. 31, 2003 (AU) ..... 2003906013

(51) Int. Cl.
*E04B 2/00* (2006.01)

(52) U.S. Cl. ..... 52/582.1; 52/528; 52/536; 52/592.1; 52/601; 52/522; 49/501; 403/291

(58) Field of Classification Search ..... 52/478, 52/309.9, 528, 533, 536, 592.6, 592.1, 601, 52/522, 547, 396.04, 396.1, 582.1; 49/501; 403/291, 375

See application file for complete search history.

(56) References Cited

U.S. PATENT DOCUMENTS

| | | | | |
|---|---|---|---|---|
| 2,644,553 | A * | 7/1953 | Cushman | 403/5 |
| 2,912,725 | A | 11/1959 | Ries | |
| 3,386,218 | A | 6/1968 | Scott | |
| 3,667,180 | A * | 6/1972 | Tischuk | 52/309.2 |
| 4,034,532 | A * | 7/1977 | Reinwall, Jr. | 52/520 |
| 4,037,377 | A * | 7/1977 | Howell et al. | 52/309.9 |
| 4,123,885 | A * | 11/1978 | Scott | 52/489.1 |
| 4,184,301 | A * | 1/1980 | Anderson et al. | 52/478 |
| 6,168,691 | B1 * | 1/2001 | Kauper et al. | 204/224 R |
| 6,453,804 | B1 * | 9/2002 | Lee | 99/470 |
| 6,619,070 | B2 * | 9/2003 | Shin | 62/440 |
| 6,679,006 | B2 * | 1/2004 | Banicevic et al. | 49/501 |

FOREIGN PATENT DOCUMENTS

| | | |
|---|---|---|
| FR | 2553159 | 4/1985 |
| GB | 1520470 | 8/1978 |
| JP | 09-209549 | 8/1997 |
| JP | 10-227559 | 8/1998 |

* cited by examiner

*Primary Examiner*—Richard E Chilcot, Jr.
*Assistant Examiner*—Chi Q Nguyen
(74) *Attorney, Agent, or Firm*—Hoffman, Wasson & Gitler

(57) ABSTRACT

A panel edge joint formed on opposing edges of a first panel (12) and second panel (22) for use in refrigeration units. The panel edge joint comprises a male part (10) extending along at least one edge of the first panel (12) and a corresponding female part (20) extending along at least one edge of second panel (22) wherein male part (10) comprises a deformable sleeve (30) forming an outer covering of male part (10). Engagement of male part (10) with female part (20) forms a seal between the first panel (12) and second panel (22).

12 Claims, 2 Drawing Sheets

PANEL EDGE JOINT

FIELD OF THE INVENTION

The present invention relates to a panel edge joint for use in refrigeration units and in particular for use in cool rooms.

BACKGROUND

Refrigeration units are commonly used in commercial environments for storing perishable items at reduced temperatures for example providing a cool room. Typically, such units consist of metal panels sandwiching an insulating material defining the perimeter of the cool room area. The temperature within the cool room may be controlled by a refrigeration system comprising a heat pump to remove heat from the cool room, thereby lowering the temperature of the cool room.

The heat pump operates against the natural flow of heat by removing the heat from the area to keep the temperature at a set point. Thus, when the temperature is higher inside or outside of the cool room, heat flows into the cooler area to overcome the difference in heat temperature gradient. These heat losses and gains affect the efficiency of the system, requiring more work to be done by the refrigeration unit to control the temperature of the room to the desired set point.

The heat pump may include at least one evaporator, compressor, condenser, and engine connected to the cooling room to pump heat out of the room. Typically such units provide 30% efficiency of the refrigeration unit, with heat losses being the major source reducing efficiency.

Commonly heat loss or gain is reduced by providing insulation between the cool room and the outer area. This is usually achieved by using polystyrene or polyurethane foam between a metallic skin to form the panels of the cool room. As the metallic panels are good conductors of heat, these panels rely on the thermal insulation properties of insulating polystyrene foam to restrict the flow of heat into the cool room.

A problem with the construction of insulated cool rooms is that heat gain can occur at the joint between adjacent insulated panels of the cool room thereby reducing the efficiency of the refrigeration unit.

Attempts have been made to overcome this problem by using a sealant such as fluid silicon sealant to seal the panels along the edge of the joints. However, this process is cumbersome and expensive due to the cost of the sealant compound and the necessity to manually pump the fluid into the joints after installation of the cool room panels.

Additionally previous joints have resulted in condensation and the collection of water occurring at the joints between the panels, thereby causing the steel of the panels to corrode and pit.

We have found a way to reduce the heat gains into the cool room thereby increasing the efficiency of the refrigeration unit. We have produced a new panel edge joint which substantially ameliorates the above problems or at least provides the user with a useful commercial choice.

STATEMENT OF INVENTION

According to a first broad form of the invention, there is provided a panel edge joint formed on opposing edges of a first and second panel for use in refrigeration units said panel edge joint comprising a male part extending along at least one edge of the first panel and a corresponding female part extending along at least one edge of a second panel wherein the male part comprises a deformable sleeve forming an outer covering of said male part whereby engagement of said male part with said female part forms a seal between the first panel and said second panel.

In a second embodiment of the invention there is provided an insulated panel having opposing edges, one opposing edge having a male part extending along at least one edge of the insulated panel and one opposing edge having a female part extending along at least one edge of the insulated panel wherein the male part comprises a deformable sleeve forming an outer covering of said male part whereby engagement of said male part with said female part forms a seal between the first insulated panel and a second insulated panel.

In a third embodiment of the invention there is provided a refrigeration room formed from panels including a panel edge joint wherein said panels having opposing edges, one opposing edge having a male part extending along at least one edge of a panel and one opposing edge having a female part extending along at least one edge of a panel wherein the male part comprises a deformable sleeve forming an outer covering of said male part whereby engagement of said male part with said female part forms a seal between a first panel and a second panel.

In a fourth embodiment of the invention there is provided a portable refrigeration room formed from panels including a panel edge joint wherein said panels having opposing edges, one opposing edge having a male part extending along at least one edge of a panel and one opposing edge having a female part extending along at least one edge of a panel wherein the male part comprises a deformable sleeve forming an outer covering of said male part whereby engagement of said male part with said female part forms a seal between a first panel and a second panel and the joined panels are formed with a refrigeration unit into an integral transportable assembly.

Each panel is generally a planar rectangular shape having two pairs of opposing edges and two opposed faces. The present invention is clearly applicable to panels of any convenient interlocking shape. The faces are generally formed from sheet metal such as steel said faces sandwich insulating foam such as polystyrene foam therebetween to form an insulated panel. The panel faces may be formed from aluminium, stainless steel or may be externally treated steel with an enamel, zinc, or plastic coating to protect the metal from corrosion. The panel surfaces will usually be formed from sheet steel punched, rolled, or pressed into the desired panel shape. While the outer surface is preferably metallic to strengthen the refrigeration unit it will be understood by a person skilled in the art that other materials could be used such as plastic or a composite material. Similarly other insulation materials could be substituted for polystyrene to provide suitable insulation against heat loss or gain. Suitable insulation materials may include rock, wool, fiberglass, cellulose, polyurethane foam or polyisocyanurate adapted for use in refrigeration panels.

The opposing edges of the panel are generally formed from the metal sheet of the faces bent into interlocking panel joints. The joints comprise a male part extending along at least one edge of a first panel and corresponding female part extending along at least one edge of a second panel. The contours of the male and female parts align in a generally parallel configuration.

The female part of the panel edge joint may be formed as a fold extending along at least one edge of the sheet metal forming a cavity to receive the male part. In particular, the female part may be formed as a parabolic, curvilinear, or concave fold cross section. Other shapes such as rectangular or triangular cross-sections will be understood to perform the same function.

The male part of the panel edge joint may be formed as a corresponding fold extending along at least one edge of the sheet metal. The male part may follow the contours of the female part and preferably forming a loose fit. The male part may be fashioned to provide a tighter fit the further it penetrates the female part, for example by using a widening end to achieve this fit. Although preferably the male part is parallel to the contours of the female part, the male part may be formed to provide at least two contacts along the female contour. Preferably the cross section of the male part is a parabolic, curvilinear, or convex cross section of appropriate dimensions to form a loose fit with the female part.

The deformable sleeve may be integrally formed with the male part or may be formed to be fit the male part. The deformable sleeve may be fitted over the outer contour of the male part and within the inner contour of the female part to provide a tight fit therebetween. The deformable sleeve may include extraneous length or width in comparison with the inner contour of the female part to ensure the male part is wedged inside the female part when the parts are mated with the sleeve therebetween. Preferably the deformable sleeve is formed as a rectangular cross section allowing the sleeve to be deformed during mating of the male and female parts.

This ensures a tight fit is achieved, even when inconsistencies occur in the dimensions of the male and female parts. The tight fit ensures the seal is secure enough to stop the flow of fluids such as air and water through the panel joint.

Additionally, by providing extraneous length and width in the deformable sleeve, the fit ensures the male part is wedged in the female part so that it is difficult to prise the two mated panels apart. This provides extra strength to the panels, increasing the joint strength and the wind loading of the joined panels.

Preferably the deformable sleeve includes at least one bead lying adjacent to the outer contour of the male part to prevent the flow of fluid therethrough. Preferably two beads are formed along each edge of the deformable sleeve to restrict the flow of fluid between the panels. These beads may be in the form of inwardly extending flanges on the edges of the deformable sleeve.

Further preferably, the deformable sleeve may include a third bead to stop the flow of water to the panel joint, thereby reducing the risk of water build up or corrosion of the panel joint. The bead may be formed as a flange along one side of the deformable sleeve in a unilateral direction to deflect the flow of liquid away from the joint.

The deformable sleeve is generally made of a suitable material to withstand the temperature gradient between the cool room and the outside air. Preferably the deformable sleeve is formed from a thermoplastic elastomer which has rubber-like characteristics as well as properties allowing it to be processed and recycled like thermoplastic materials. Santoprene™ (Advanced Elastomeric System) is an example of such a compound of rubber and plastic, suitable to withstand cool room temperatures. While Santoprene has functional performance and properties similar to conventional thermoset rubber products, it may be processed with the speed, efficiency, and economy of thermoplastics. Additionally, Santoprene is easier to recycle as scrap and provides closer dimensional consistency and product quality compared to thermoset rubber products, as Santoprene has a small amount of permanent plastic deformation and little shrinkage. Additionally, Santoprene is well suited for temperatures below 0° C. as its brittle point (for most grades) allow flexibility to −57° C. These thermal properties allow Santoprene to withstand the low temperatures of the cool room and temperature differential between inside and outside temperatures without becoming brittle or rigid.

Additionally, Santoprene is UV stabilised to ensure the joint does not deteriorate due to exposure to light.

It would be understood by a person skilled in the art the other suitable materials could be used such as rubber/plastic composites having appropriate heat and water resistant characteristics, suitable for use in the cool room.

The joint is formed by stretching the deformable sleeve over the male part to form an outer covering. The deformable sleeve may be left in place covering the male part prior to installation of the cool room. During installation, the covered male part on one panel is paired with a corresponding female part on another panel so they two panels may be joined.

The covered male part is inserted into the female part to make the panel joint and engagement is encouraged by applying force to one or both panels. This force urges the covered male part to penetrate deeper in engagement with the female part to provide the desired tight fit. More rapid and strong applied forces may result in a deeper and tighter the fit between the two parts, as the sleeve is distorted within the joint.

Preferably the deformable sleeve includes a bead along one edge. This bead may engage with the edge of the male part forming a seal to stop the flow of fluid and heat therebetween. A second bead may be formed on the second edge of the deformable sleeve to provide a second seal between the male part and the deformable sleeve. One of these beads may wrap over the edge of the male part forming a seal.

Preferably a third bead may be provided between the deformable sleeve and the female part to ensure that no water or liquid is allowed to flow therebetween. The bead may be formed as a flange, located in a unilateral direction away from the edge of the deformable sleeve. The direction of the flange ensures that the seal becomes stronger as liquid, in particular water, pushes against the deformable sleeve.

A preferred embodiment of the invention will now be described, by way of example only, in reference to the following drawings.

DETAILED DESCRIPTION OF THE INVENTION

Figure 1:
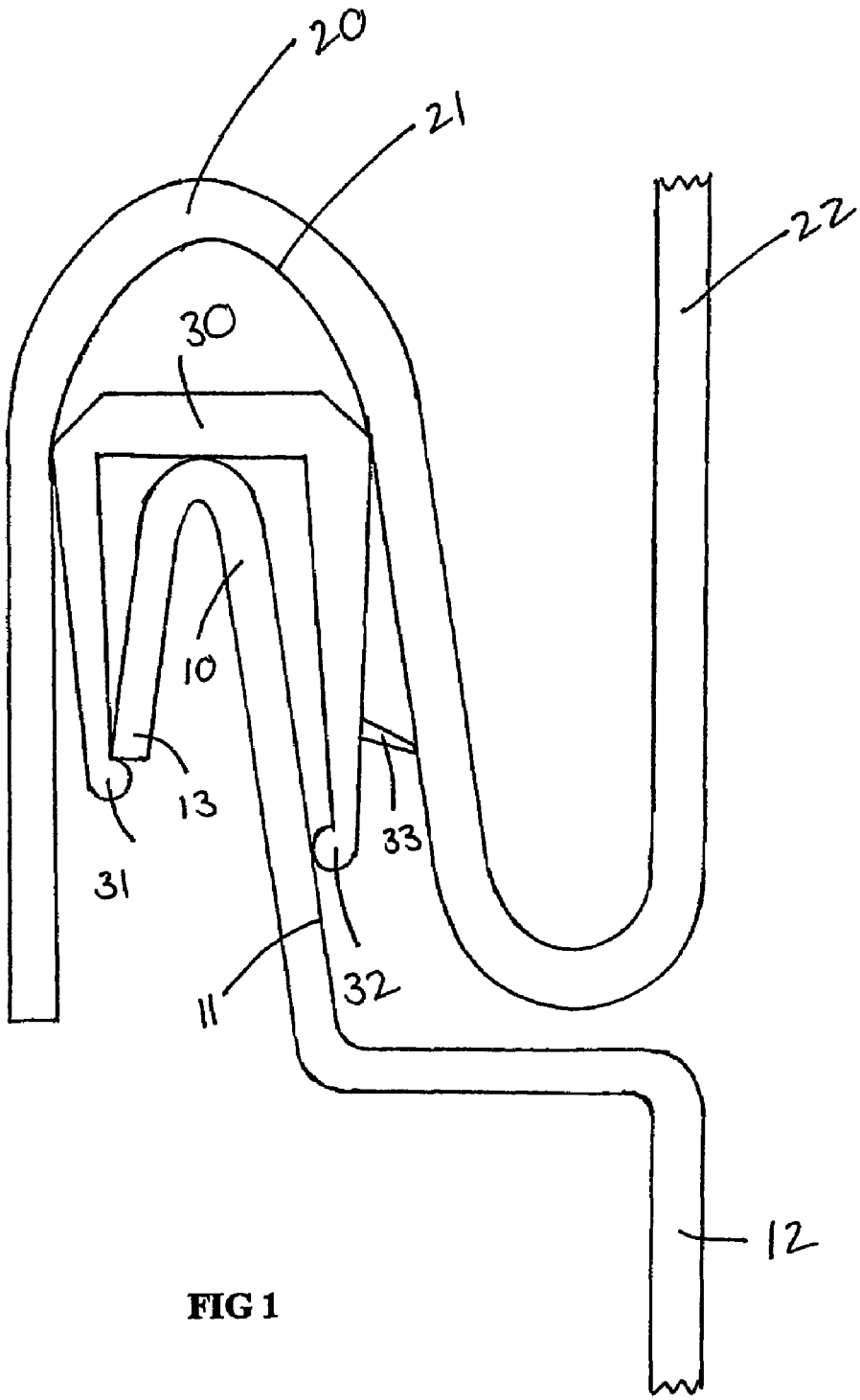
FIG. 1 shows a side view of the panel joint according to a preferred embodiment of the invention.

FIG. 1 shows a panel edge joint formed on opposing edges of a first panel 12 and second panel 22, said panels forming the boundary of a refrigeration unit cool room. The panel edge joint comprises a male part 10 extending along at least one edge of the first panel 12 and a corresponding female part 20 extending along at least one edge of a second panel 22. The male part 10 and the female part 20 sandwiching a deformable sleeve 30 therebetween.

The female part 20 has an inner contour 21 which corresponds with the outer contour of the male part. The dimensions of the parts allows for a loose fit of the parts with space between the outer male contour and inner female contour to accommodate the thickness of the deformable sleeve.

The deformable sleeve 30 is formed to have geometry such that the sleeve fits between the male and female parts to provide a tight fit. Preferably the geometry of the deformable sleeve 30 is slightly rectangular in comparison to the curvilinear or parabolic male and female parts to allow air gaps such that the deformable sleeve may fit more snugly into the contours of the male and female parts when irregularities occur in the dimensions of the parts. This shape accommodates a larger range of tolerances in the manufacture of the male part 10 and female part 20.

Preferably the deformable sleeve 30 includes a bead 31 along one of its edges. This bead 31 is shown to engage with the edge of the male part 14 forming a seal to stop the flow of fluid and heat therebetween. A similar bead 32 may formed on the other edge of the deformable sleeve to provide a second seal between the male part 10 and the deformable sleeve 30.

Additionally a third bead 33 may be provided between the deformable sleeve 30 and the female part 20 to ensure that no water or liquid is allowed to flow therebetween. The bead 33 may be formed as a flange, located in a unilateral direction away from the edge of the deformable sleeve 30. The direction of the flange ensures that the seal becomes stronger as liquid, in particular water, pushes against the deformable sleeve 30. This restricts the flow of water therethrough and may reduce corrosion at the joints between the panels.

Figure 2:
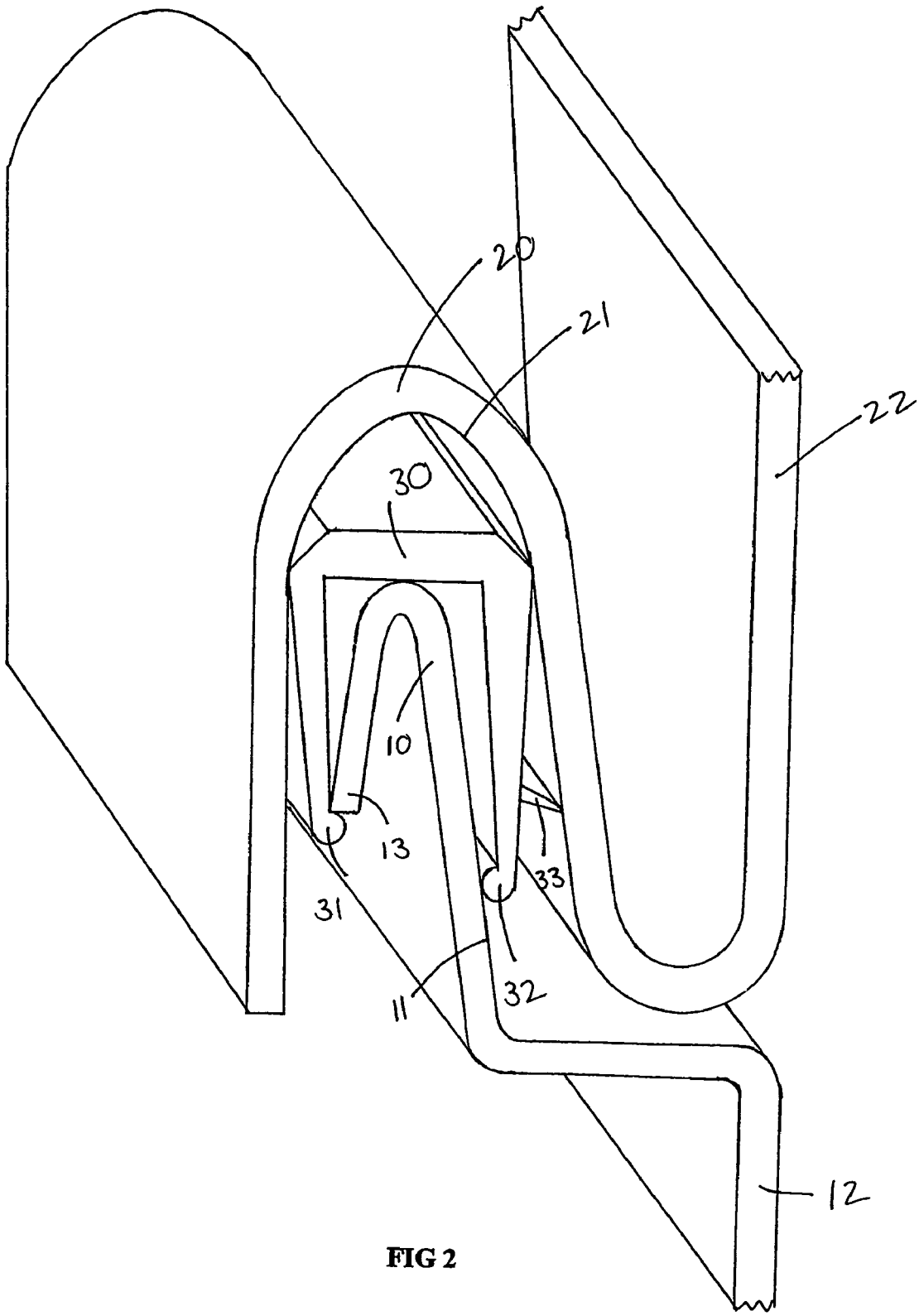
FIG. 2 shows a side view of the panel joint according to a preferred embodiment of the invention.

FIG. 2 shows the panels 22, 12 and panel joint extending laterally. The width of the panels 12, 22 is shown to determine the length of the joint therebetween. The deformable sleeve, 30 is formed into a continuous length that is applied to the male part 10 and cut to length according to the width of the panel 12.

Whilst the above has been given by way of illustrative example of the invention, many modifications and variations may be made thereto by persons skilled in the art without departing from the broad scope and ambit of the invention as herein set forth.

The term "comprise", or variations of the term such as "comprises" or "comprising", are used herein to denote the inclusion of a stated integer or stated integers but not to exclude any other integer or any other integers, unless in the context or usage an exclusive interpretation of the term is required.

The claims defining the invention are as follows:

1. A panel edge joint formed on opposing edges of first and second panels of a refrigeration units, said panel edge joint comprising a male part extending along at least one edge of the first panel and a corresponding female part extending along at least one edge of a second panel wherein the male part comprises a deformable element forming an outer covering of said male part whereby engagement of said male part with said female part forms a seal between the first panel and said second panel; and wherein the female part of the panel edge joint is formed as a fold extending along at least one edge of the sheet metal forming a cavity to receive the male part.

2. The panel edge joint according to claim 1 wherein the male part of the panel edge joint is formed as a fold extending along at least one edge of the sheet metal.

3. The panel edge joint according to claim 1 wherein the deformable element is integrally formed with the male part.

4. The panel edge joint according to claim 1 wherein the deformable element is fitted over the outer contour of the male part and within the inner contour of the female part to provide the seal therebetween.

5. The panel edge joint according to claim 1 wherein the deformable element defines at least one bead lying adjacent to an outer contour of the male part to prevent the flow of fluid therethrough.

6. The panel edge joint according to claim 5 wherein two beads are formed at free ends of the deformable element to restrict the flow of fluid between the panels.

7. An insulated panel, said panel having opposing edges, one opposing edge having a male part extending along at least one edge of the insulated panel and one opposing edge having a female part extending along at least one edge of the insulated panel wherein the male part comprises a deformable element forming an outer covering of said male part whereby engagement of said male part with said female part forms a seal between the first insulated panel and a second insulated panel; and wherein the female part of the panel edge joint is formed as a fold extending along at least one edge of the sheet metal forming a cavity to receive the male part.

8. The insulated panel according to claim 7 wherein the male part of the panel edge joint is formed as a fold extending along at least one edge of the sheet metal.

9. The insulated panel according to claim 7 wherein the deformable element is integrally formed with the male part.

10. The insulated panel according to claim 7 wherein the deformable element is fitted over the outer contour of the male part and within the inner contour of the female part to provide the seal therebetween.

11. The insulated panel according to claim 7 wherein the deformable element defines at least one bead lying adjacent to an outer contour of the male part to prevent the flow of fluid therethrough.

12. The insulated panel according to claim 11 wherein two beads are formed at free ends of the deformable element to restrict the flow of fluid between the panels.

* * * * *